US010239193B2

(12) United States Patent
Herr

(10) Patent No.: US 10,239,193 B2
(45) Date of Patent: Mar. 26, 2019

(54) HANDHELD TOOL APPARATUS

(71) Applicant: Robert Bosch GmbH, Stuttgart (DE)

(72) Inventor: Tobias Herr, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 948 days.

(21) Appl. No.: 14/120,384

(22) Filed: May 14, 2014

(65) Prior Publication Data

US 2014/0338946 A1 Nov. 20, 2014

(30) Foreign Application Priority Data

May 14, 2013 (DE) ..... 10 2013 208 895

(51) Int. Cl.

| | |
|---|---|
| ***B25D 9/00*** | (2006.01) |
| ***B25D 11/00*** | (2006.01) |
| ***B25B 23/147*** | (2006.01) |
| ***B25B 21/02*** | (2006.01) |
| ***B25D 11/10*** | (2006.01) |
| ***B25D 16/00*** | (2006.01) |
| ***B25B 23/14*** | (2006.01) |
| ***B25D 17/06*** | (2006.01) |

(52) U.S. Cl.

CPC ..... *B25B 23/1475* (2013.01); *B25B 21/02* (2013.01); *B25B 21/023* (2013.01); *B25B 23/141* (2013.01); *B25D 11/10* (2013.01); *B25D 11/104* (2013.01); *B25D 16/00* (2013.01); *B25D 16/006* (2013.01); *B25D 17/06* (2013.01); *B25D 2216/0023* (2013.01); *B25D 2216/0038* (2013.01); *B25D 2217/0015* (2013.01)

(58) Field of Classification Search

CPC ..... B25B 23/14; B25B 21/00; B25B 21/026; B25D 2216/0069

USPC ..... 173/104, 156

See application file for complete search history.

(56) References Cited

U.S. PATENT DOCUMENTS

| | | | | |
|---|---|---|---|---|
| 7,201,235 | B2 * | 4/2007 | Umemura | B23B 45/008 173/104 |
| 7,410,007 | B2 * | 8/2008 | Chung | B25B 21/02 173/176 |
| 9,827,660 | B2 * | 11/2017 | Blum | B25D 16/006 |
| 2009/0151966 | A1 * | 6/2009 | Chen | B25B 21/02 173/48 |
| 2013/0161043 | A1 * | 6/2013 | Blum | B25D 16/006 173/48 |
| 2014/0182870 | A1 * | 7/2014 | Herr | B25D 11/104 173/94 |
| 2015/0000951 | A1 * | 1/2015 | Hecht | B25F 5/00 173/213 |

FOREIGN PATENT DOCUMENTS

DE 10 2009 000065 7/2010

* cited by examiner

*Primary Examiner* — Andrew M Tecco
*Assistant Examiner* — Eyamindae Jallow
(74) *Attorney, Agent, or Firm* — Norton Rose Fulbright US LLP; Gerard Messina

(57) ABSTRACT

A handheld tool apparatus comprising a spindle blocking apparatus and a torque limiting unit that includes at least one limiting spring and a stop arrangement that is supported movably against the limiting spring. It is provided that the stop arrangement of the torque limiting unit nonrotatably secure a wedging arrangement of the spindle blocking apparatus.

15 Claims, 15 Drawing Sheets

A - A

B - B

C - C

D - D

E - E

F - F

G - G

H - H

I - I

J - J

HANDHELD TOOL APPARATUS

RELATED APPLICATION INFORMATION

The present application claims priority to and the benefit of German patent application no. 10 2013 208 895.7, which was filed in Germany on May 14, 2013, the disclosure of which is incorporated herein by reference.

FIELD OF THE INVENTION

A handheld tool apparatus having a spindle blocking apparatus and having a torque limiting unit that has at least one limiting spring and one stop arrangement that is supported movably against the limiting spring.

SUMMARY OF THE INVENTION

The present invention relates to a handheld tool apparatus having a spindle blocking apparatus and having a torque limiting unit that has at least one limiting spring and one stop arrangement that is supported movably against the limiting spring.

It is provided that the stop arrangement of the torque limiting unit nonrotatably secure a wedging arrangement of the spindle blocking apparatus. A "spindle blocking apparatus" is to be understood in particular as an apparatus which is provided in order to terminate a motion of the tool spindle in the context of a torque, in particular a torque applied by the operator on a tool chuck, applied on the tool spindle that moves the tool spindle too little. The spindle blocking apparatus may transfer a torque proceeding from a drive unit, in particular directly, onto the tool spindle. A spindle blocking apparatus of this kind is discussed in further detail in particular in the document DE 10 2009 000 065 A1. "Provided" is to be understood in particular to mean specially programmed, configured, and/or equipped. A "torque limiting unit" is to be understood in particular as a unit that, in at least one operating state, limits a maximum torque exertable on the tool spindle. The torque limiting unit may open at least one clutch when a torque exerted on the tool spindle reaches a maximum torque that in particular is adjustable by an operator. A "limiting spring" is to be understood in particular as a spring which is provided in order to hold a clutch of the torque limiting unit closed at a torque lower than the maximum torque. The torque limiting unit may have multiple limiting springs.

Alternatively, the torque limiting unit could have only one limiting spring. The limiting spring may exert a force on the stop arrangement. A "stop arrangement" is to be understood in particular as an arrangement of the torque limiting unit which is provided in order to be disposed in terms of action between the limiting spring and the limiting arrangement. The stop arrangement may direct the force of the limiting spring toward the clutch of the torque limiting unit. Advantageously, the limiting arrangement presses directly onto the stop arrangement. Several of the limiting springs of the torque limiting unit may exert a force on the stop arrangement. The stop arrangement may convey the force of the at least one limiting spring into one or advantageously several limiting arrangement. A "limiting arrangement" is to be understood in particular as an arrangement that, in order to limit the torque, is supported movably against at least one limiting spring, and that discharges the force, acting in a circumferential direction, of the clutch of the torque limiting unit toward the handheld tool housing. The limiting arrangement may act directly on a part of a gearbox stage of the gearbox, in particular on a ring gear. The torque limiting unit may have multiple limiting arrangements. The at least one limiting arrangement may be configured as a ball.

Alternatively, the at least one limiting arrangement could have a different shape that seems sensible to one skilled in the art, for example a roller shape. In particular, the stop arrangement and the at least one limiting arrangement are embodied separately. Alternatively, the at least one limiting arrangement and the stop arrangement could be embodied integrally. A limiting arrangement guidance arrangement of the torque limiting unit axially may displaceably support the limiting arrangement. A "limiting arrangement guidance arrangement" is to be understood in particular as an arrangement which is provided in order to secure at least one limiting arrangement in a circumferential direction and support it movably in an axial direction. The limiting arrangement guidance arrangement may be connected fixedly to the handheld tool housing. The expression "supported movably against the limiting spring" is to be understood to mean that the limiting arrangement is supported axially displaceably, and compresses the limiting spring upon at least a motion in an axial direction. A "wedging arrangement" is to be understood in particular as an arrangement which is provided in order to discharge toward the handheld tool housing the torque applied onto the tool spindle. The wedging arrangement may have a wedging surface on which a blocking arrangement of the spindle blocking apparatus acts. The spindle blocking apparatus may have a further wedging surface that, at least in the context of a drilling mode, is constantly connected nonrotatably to the tool spindle.

In particular, the blocking arrangement wedges between the wedging surface of the wedging arrangement and the further wedging surface in order to secure the tool spindle. The expression "nonrotatably secure" is to be understood in particular to mean that the spindle blocking apparatus nonrotatably connects the tool spindle and the handheld tool housing. A particularly small physical size can be achieved as a result of the configuration according to the present invention of the handheld tool apparatus.

In a further embodiment it is provided that the handheld tool apparatus have a gearbox housing that nonrotatably secures the stop arrangement, thereby enabling a simple configuration. A "gearbox housing" is to be understood in particular as a housing which is provided in order to protect the gearbox, at least in a radial direction, at least from penetration of dust. The gearbox housing may completely surround the gearbox on at least one plane. At least one ring gear of a gearbox stage of the gearbox may be nonrotatably connected to the gearbox housing in at least one operating mode. In particular, no further component is disposed between at least one component of the gearbox and the gearbox housing.

It is furthermore provided that the torque limiting unit be provided in order to close off, in a ready-to-operate state, a side of the gearbox housing facing toward an inserted tool securing device, with the result that an advantageously modular configuration can be achieved. In particular, the gearbox can be simply and quickly installed and, in particular, replaced. An "inserted tool securing device" is to be understood in particular as an apparatus which is provided in order to secure an inserted tool in a manner releasable, in particular without tools, by an operator. The inserted tool securing device may be connected nonrotatably to a tool spindle of the handheld tool apparatus. Advantageously, the inserted tool securing device is connected in nondestructively releasable fashion to the tool spindle.

It is furthermore provided that the handheld tool apparatus encompass an impact mechanism gearbox which is provided in order to increase a rotation speed for impact generation, thereby enabling a particularly effective impact drilling mode. The impact mechanism gearbox may have a planetary gearbox stage. The expression "increase a rotation speed for impact generation" is to be understood in particular to mean that an input-drive-side rotation speed of the impact mechanism gearbox is lower than an output-drive-side rotation speed of the impact mechanism gearbox.

It is further provided that the handheld tool apparatus encompass a drive unit and a gearbox which is provided in order to reduce a rotation speed of the drive unit, with the result that an advantageously high torque can be achieved at the tool spindle. A "drive unit" is to be understood in particular as a unit which is provided in order to convert an (in particular, electrical or pneumatic) power output into a rotary motion. The drive unit may be embodied as an electric motor. A "gearbox" is to be understood in particular as an apparatus which is provided in order, upon operation, to convert a rotation speed of a drive unit of the handheld tool apparatus to a lower rotation speed of the tool spindle. The gearbox may have at least one, which may be at least two, and may particularly be at least three planetary gearbox stages. The gearbox may be provided in order to furnish at least two conversion relationships between the rotation speed of a drive unit and the rotation speed of the tool spindle. The expression "reduce a rotation speed" is to be understood to mean that an input-drive-side rotation speed of the gearbox is lower than an output-drive-side rotation speed of the gearbox.

It is moreover provided that the stop arrangement be disposed between the impact mechanism gearbox and the gearbox, with the result that a small physical size can be achieved. The expression "between" is to be understood in particular to mean that the stop arrangement is located on a straight line between two points, of which one is located in a space of the impact mechanism gearbox and one in a space of the gearbox.

It is furthermore provided that the handheld tool apparatus have an impact mechanism having a striker and having at least one cam guide that drives the striker at least in an impact drilling mode, with the result that a particularly small, light, and nevertheless high-performance impact mechanism can be furnished. An "impact mechanism" is to be understood in particular as an apparatus which is provided in order to generate a percussive pulse and deliver it in particular toward an inserted tool. The impact mechanism may convey the percussive pulse, at least in an impact drilling mode, advantageously via the tool spindle and/or in particular via the inserted tool securing device, to the inserted tool. The impact mechanism may be provided in order to convert a rotational motion into an, in particular translational, impact motion. In particular, the impact mechanism is not embodied as a ratchet impact mechanism. The term "striker" is to be understood in particular as an arrangement that, at least in the impact drilling mode, is in particular accelerated at least substantially translationally, and delivers a pulse, received in the context of the acceleration, as a percussive pulse toward the inserted tool. The striker may be embodied integrally.

Alternatively, the striker could be embodied in multiple parts. A "cam guide" is to be understood in particular as an apparatus that converts a rotational energy for impact generation, at least by way of a specially shaped guidance surface along which a connecting arrangement runs at least in an impact drilling mode, into a linear motion energy of the striker. The impact mechanism may have an impact mechanism spring that stores the linear motion energy of the striker for impact generation. The specially shaped guidance surface may be a surface that delimits a guidance cam of the cam guide. The cam guide may be provided in order to move the striker for an impact one time for one revolution of an impact mechanism spindle of the handheld tool apparatus. Alternatively, the cam guide could be provided in order to move the striker for at least two or advantageously three impacts for one revolution of the impact mechanism spindle. In this case the impact mechanism gearbox could in particular be omitted. The cam guide may exert on the striker a force that is directed away from the inserted tool securing device. A "connecting arrangement" is to be understood in particular as an arrangement that creates a mechanical coupling between at least one part of the impact mechanism which is moved rotationally in an impact drilling mode, in particular an impact mechanism spindle, and the in particular linearly moved striker. The connecting arrangement may be embodied spherically. Alternatively, the connecting arrangement could have a different shape that seems sensible to one skilled in the art. The connecting arrangement may have a diameter greater than 4 mm, advantageously greater than 5 mm, particularly advantageously greater than 6 mm. The connecting arrangement may have a diameter less than 14 mm, advantageously less than 10 mm, particularly advantageously less than 8 mm.

A "guidance cam" is to be understood in particular as a region, delimited by the guidance surface, in which the connecting arrangement runs in at least one operating state. The impact mechanism may have exactly the one cam guide having exactly the one guidance cam, and at least the one connecting arrangement. Alternatively, the impact mechanism could have two or, in particular, more than two guidance cams each having exactly one cam guide and at least one connecting arrangement. An "impact drilling mode" is to be understood in particular as an operating mode of the handheld tool apparatus in which the inserted tool is driven in rotating and impacting fashion in the context of workpiece processing.

In an advantageous embodiment of the invention, it is provided that the striker have at least a part of the cam guide, thereby enabling a particularly small, light, and nevertheless high-performance impact mechanism. The expression "the striker has at least a part of the cam guide" is to be understood in particular to mean that the striker has a surface onto which the connecting arrangement directly transfers the energy for generating the impact motion. The part of the cam guide that has the striker may be embodied as a surface that secures the connecting arrangement in stationary fashion relative to the striker. Advantageously, that part of the cam guide which has the striker encompasses a securing cutout, delimited by the surface, which secures the connecting arrangement in stationary fashion relative to the striker. Advantageously, the striker is provided in order to secure the connecting arrangement that, in one operating mode, connects the part of the cam guide and a further part of the cam guide, in particular the guidance cam. The connecting arrangement and the striker may be connected nonresiliently. This arrangement in particular that a spring is not disposed in terms of action between the connecting arrangement and the striker. Alternatively, the connecting arrangement could be embodied at least in part integrally with the striker. In addition, alternatively that part of the cam guide which has the striker could be embodied as a guidance cam. "Stationary" is to be understood in particular to be an arrangement that an axis of symmetry and/or a center point of the connecting arrangement is at least substantially unmoved relative to the striker in the context of an impact mode.

In a further embodiment it is provided that the handheld tool apparatus have an inserted tool securing device, the gearbox housing being fitted, in a ready-to-operate state, with at least one planetary gearbox stage of the gearbox from a side facing toward the inserted tool securing device, with the result that an advantageously modular configuration can be achieved. In particular, the gearbox can be replaced simply and quickly. A "side facing toward the inserted tool securing device" is to be understood in particular to mean a part of a region, surrounded by the gearbox housing, that is first intersected by rays proceeding from the inserted tool securing device. The side facing toward the inserted tool securing device may have a dimension in an axial direction of less than 10 mm. A "planetary gearbox stage" is to be understood in particular as a unit having a sun gear, a ring gear, and at least one planet gear guided by a planet carrier on a circular path around the sun gear. The gearbox housing may be fitted with at least two planetary gearbox stages from the side facing toward the inserted tool securing device. Alternatively or additionally, the gearbox housing could be fitted with at least one planetary gearbox stage of the gearbox from a side facing away from the inserted tool securing device.

Particularly, the gearbox housing may be fitted with all the planetary gearbox stages of the gearbox from the side facing toward the inserted tool securing device. The term "fitted" is to be understood in particular to mean that in the context of assembly of the planetary gearbox stage, the components of the planetary gearbox stage are conveyed to their working location, in particular inside the gearbox housing, through that side of the gearbox housing which faces toward the inserted tool securing device. A side of the gearbox housing facing toward the inserted tool securing device may be closed off by a gearbox housing cover upon fitting of the gearbox housing.

The handheld tool apparatus according to the present invention is not to be restricted here to the utilization and embodiment described above. In particular, the handheld tool apparatus according to the present invention can have, in order to perform a function described herein, a number of individual elements, components, and units that differs from a number recited herein.

Further advantages are evident from the description below of the drawings. The drawings depict an exemplifying embodiment of the invention. The drawings, the description, and the claims contain numerous features in combination. One skilled in the art will usefully also consider the features individually and combine them into appropriate further combinations.

DETAILED DESCRIPTION

Figure 1:
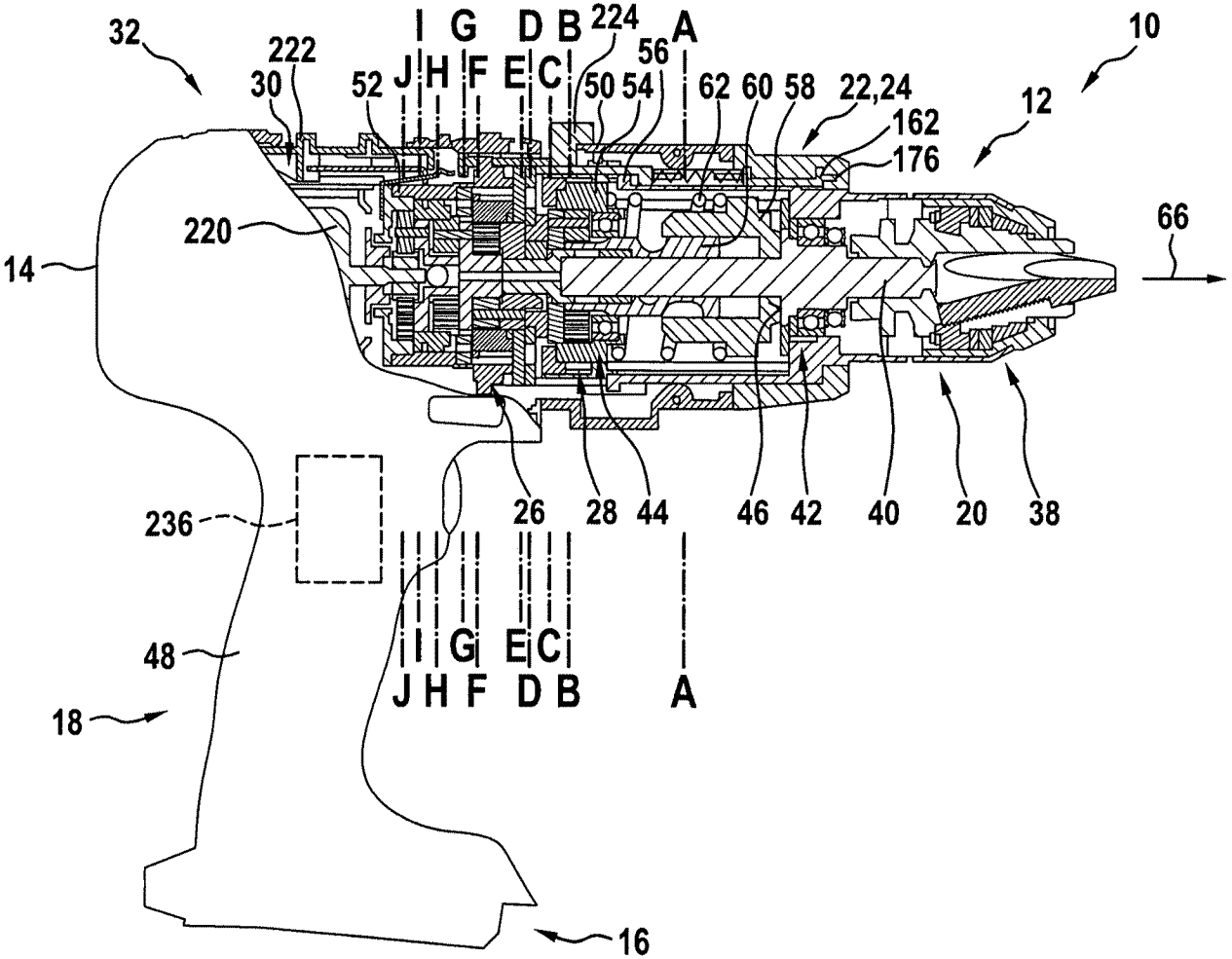
FIG. 1 shows a section through a handheld tool having a handheld tool apparatus according to the present invention.

FIG. 1 shows a handheld tool 10. Handheld tool 10 is embodied as an impact drill driver. Handheld tool 10 has a handheld tool apparatus 12 according to the present invention, a handheld tool housing 14, and a rechargeable battery interface 16. Rechargeable battery interface 16 is provided in order to supply handheld tool apparatus 12 with electrical energy from a handheld tool rechargeable battery (not depicted in further detail). Handheld tool housing 14 is embodied substantially in a pistol shape. It encompasses a handle 18 by way of which an operator holds handheld tool 10 in the context of a working operation. Handheld tool apparatus 12 encompasses a tool guidance unit 20, an impact mechanism 22, an impact shutoff apparatus 24, a gearbox 26, an impact mechanism gearbox 28, a drive unit 30, an operating apparatus 32, a torque limiting unit 24, and a spindle blocking apparatus 36. Drive unit 30 is embodied as an electric motor. Gearbox 26 is provided in order to reduce a rotation speed of drive unit 30. Gearbox 26 is furthermore provided in order to furnish at least two different conversion relationships.

A grip surface of handle 18 is embodied substantially perpendicular to a rotation axis of tool guidance unit 20. Handheld tool housing 14 has an overhang on a side facing away from tool guidance unit 20 with reference to handle 18. A basic shape of handheld tool housing 14 is therefore T-shaped.

Tool guidance unit 20 encompasses an inserted tool securing device 38 and a tool spindle 40. Inserted tool securing device 38 and tool spindle 40 are bolted to one another. Alternatively, inserted tool securing device 38 and tool spindle 40 could be connected, releasably without tools, in a manner that seems sensible to one skilled in the art.

Inserted tool securing device 38 secures an inserted tool (not depicted here), for example a drill or a screwdriver bit, in the context of a working operation. Inserted tool securing device 38 secures the inserted tool nonpositively. Alternatively or additionally, an inserted tool securing device could secure the inserted tool positively, for example with an SDS tool chuck or a hex holder. Inserted tool securing device 38 has three clamping jaws, secured movably by an operator, that secure the inserted tool in the context of a working operation. In addition, inserted tool securing device 38 secures the inserted tool in the context of a working operation axially immovably with respect to inserted tool securing device 38 and in particular with respect to tool spindle 40. A portion of inserted tool securing device 38, and tool spindle 40, are connected to one another immovably relative to each other. Here, inserted tool securing device 38 and tool spindle 40 are bolted to one another.

Handheld tool apparatus 12 has a bearing arrangement 42 that supports tool spindle 40 on a side facing toward inserted tool securing device 38. Bearing arrangement 42 supports tool spindle 40 axially displaceably. Bearing arrangement 42 is connected axially fixedly to tool spindle 40. Bearing arrangement 42 is supported axially movably in handheld tool housing 14. Handheld tool apparatus 12 has a further bearing arrangement 44 that supports tool spindle 40 in a side facing toward gearbox 26. Bearing arrangement 44 is embodied as a plain bearing. Bearing arrangement 44 supports tool spindle 40 axially displaceably. Tool spindle 40 encompasses an impact surface 46 onto which impact mechanism 22 strikes in the context of an impact drilling mode as depicted.

Handheld tool housing 14 is embodied in multiple parts. Handheld tool housing 14 encompasses a two-shell handle and drive housing 48, a two-shell outer housing 50, a gearbox housing 52, an impact mechanism gearbox housing 54, and an impact mechanism housing 56. These parts of handheld tool housing 14 are manufactured separately from one another. Handle and drive housing 48 forms handle 18 and surrounds drive unit 30. Outer housing 50 surrounds gearbox housing 52 and impact mechanism gearbox housing 54. In addition, outer housing 50 secures gearbox housing 52, impact mechanism gearbox housing 54, and impact mechanism housing 56 nonpositively on handle and drive housing 48. Gearbox housing 52 surrounds gearbox 26. It is embodied in tubular fashion. Impact mechanism gearbox housing 54 surrounds impact mechanism gearbox 28. Impact mechanism housing 56 surrounds impact mechanism 22. It is likewise embodied in tubular fashion.

Figure 2:
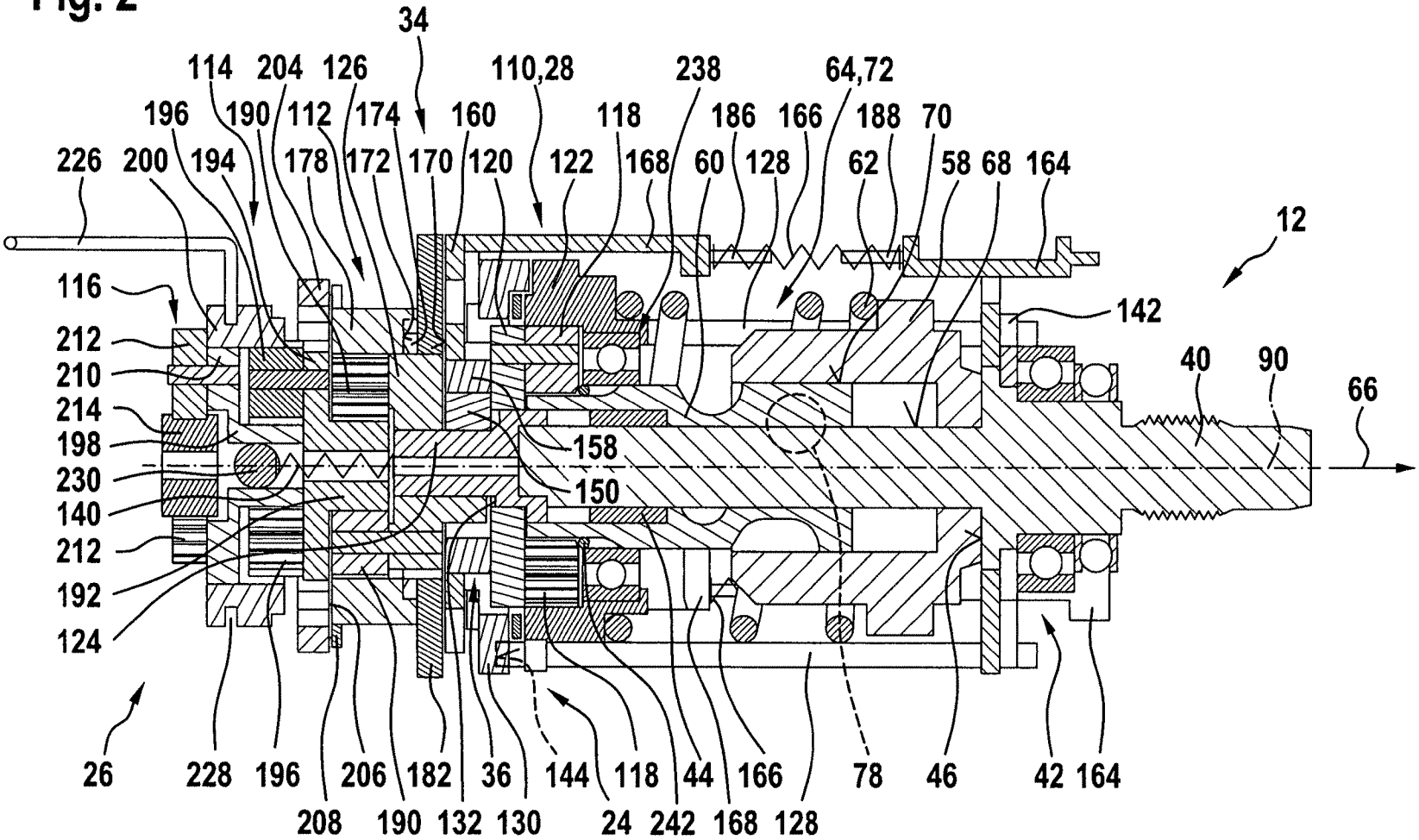
FIG. 2 shows a partly cropped section through an impact mechanism and a planetary gearbox of the handheld tool apparatus of FIG. 1.

FIG. 2 depicts impact mechanism 22 and gearbox 26, impact mechanism gearbox 28, torque limiting unit 34, and spindle blocking apparatus 36 in further detail. Impact mechanism 22 is switchable into an activated and a deactivated operating state. Impact mechanism 22 has a striker 58, an impact mechanism spindle 60, an impact mechanism spring 62, and a striker drive apparatus 64. Impact mechanism spindle 60 surrounds bearing arrangement 44 that supports tool spindle 40 on a side facing toward gearbox 26. Bearing arrangement 44 is disposed in terms of action between tool spindle 40 and impact mechanism spindle 60. Striker 58 is supported translationally movably in an impact direction 66. Impact direction 66 is oriented parallel to an axial direction of impact mechanism spindle 60.

Tool spindle 40 and impact mechanism spindle 60 have a respective bearing surface 68, 70 on which striker 58 is movably supported. Bearing surfaces 68, 70 act directly on striker 58. Bearing surfaces 68, 70 are enveloping surfaces respectively of tool spindle 40 and of impact mechanism spindle 60. Alternatively, striker 58 could be supported only on tool spindle 40 or on impact mechanism spindle 60, and optionally on an outer side of striker 58. An inner side of striker 58 delimits an interior space that narrows inward in impact direction 66. Bearing surface 68 of tool spindle 40 acts on a narrowed region of the inner side of striker 58. Bearing surface 70 of impact mechanism spindle 60 acts on an un-narrowed region, facing toward gearbox 26, of the inner side of striker 58. Striker 58 has a cup-like basic shape, a cutout through which tool spindle 40 extends being disposed in the bottom of the cup-like basic shape. Upon operation, striker 58 strikes with an outer bottom side of the cup-like basic shape against tool spindle 40. Striker 58 surrounds tool spindle 40 and impact mechanism spindle 60 through 360 degrees at least in a plane that is oriented perpendicular to impact direction 66.

Alternatively, an impact mechanism could have a striker and an impact mechanism spindle, such that the impact mechanism spindle surrounds the striker. In this case a cam guide of the impact mechanism would be disposed on an outer side of the striker. Either the striker or the impact mechanism could have a guidance cam of the cam guide. As a result of a larger radius of the cam guide, it would be advantageous in this case if the cam guide were provided in order to move the striker for an impact several times for one revolution.

Figure 3:
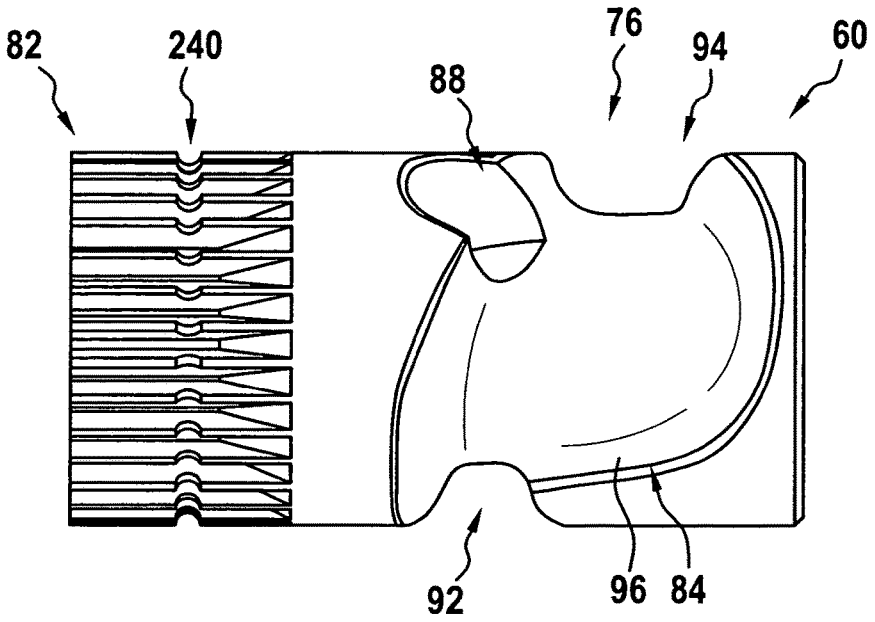
FIG. 3 shows a first side view of a striker of the impact mechanism of the handheld tool apparatus of FIG. 1.
Figure 4:
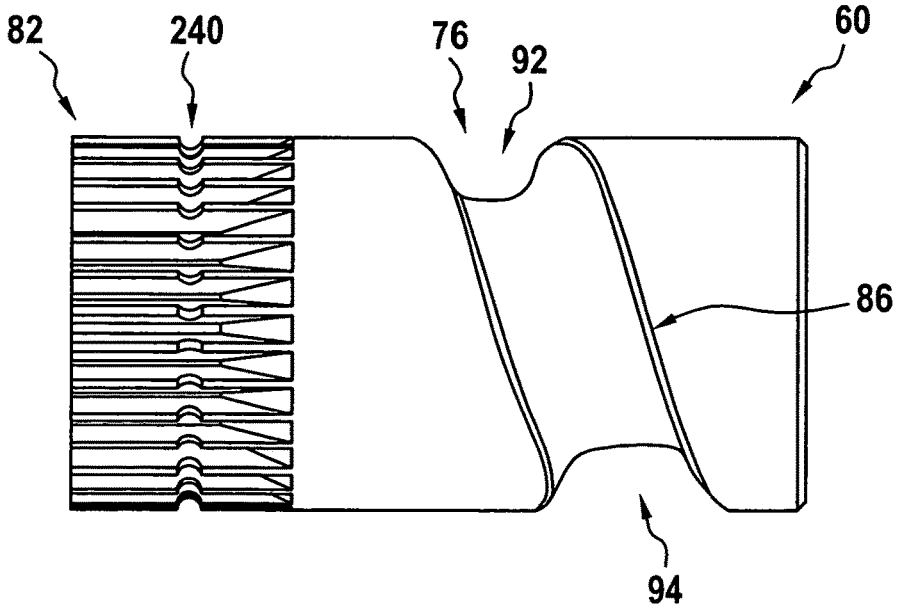
FIG. 4 shows a second side view of the striker of FIG. 3 from an opposite side.
Figure 5:
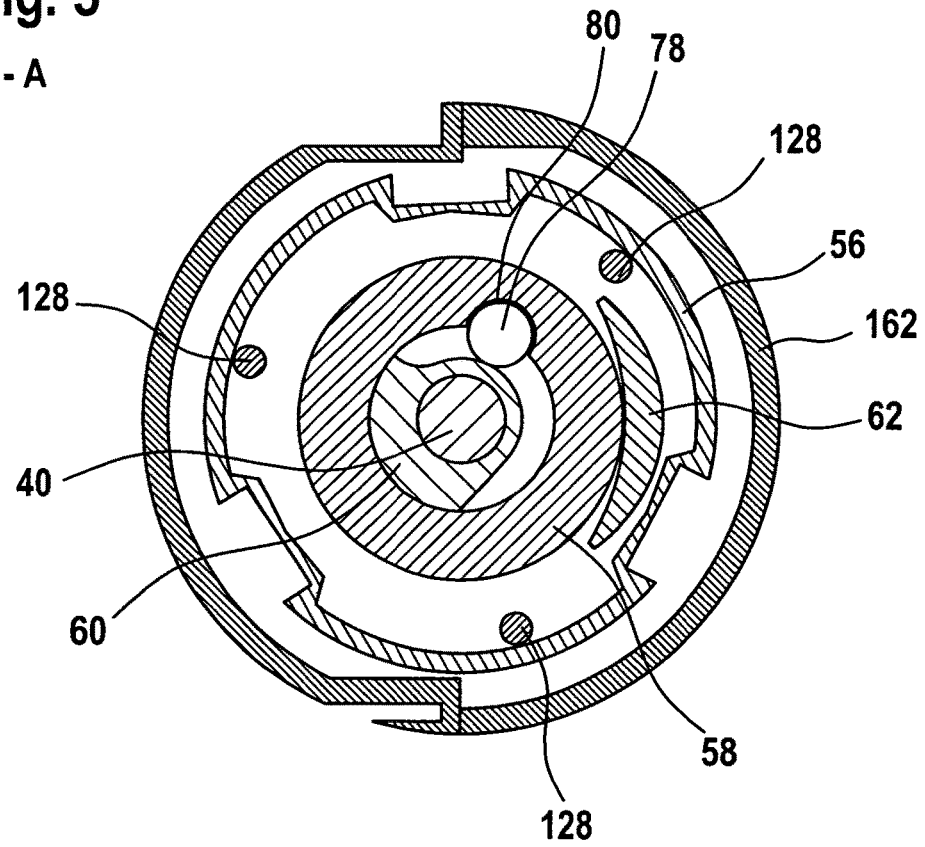
FIG. 5 shows a first section surface A of the impact mechanism of the handheld tool apparatus of FIG. 1.

FIGS. 3 and 4 show impact mechanism spindle 60 in two side views differing by 180 degrees. FIG. 5 shows a section surface A of striker drive apparatus 64. Striker drive apparatus 64 has exactly one cam guide 72. Cam guide 72 encompasses a guidance cam 76, a connecting arrangement 78, and a securing arrangement 80. Cam guide 72 is disposed on impact mechanism spindle 60. Alternatively, at least one cam guide could be disposed on a striker. Securing arrangement 80 is disposed on striker 58. Striker 58 thus has a portion of cam guide 72. Alternatively, at least one securing arrangement could be disposed on an impact mechanism spindle.

Securing arrangement 80 is embodied as a securing cutout for connecting arrangement 78. Securing arrangement 80 is disposed on an inner side of striker 58. Securing arrangement 80 is introduced into the inner side of striker 58 by way of an orifice through a side of striker 58 facing away from the securing arrangement. Connecting arrangement 78 is embodied as a ball. Connecting arrangement 78 has a diameter of 7 mm. Securing arrangement 80 supports connecting arrangement 78 in stationary fashion relative to striker 58. In the impact drilling mode, connecting arrangement 78 slides in guidance cam 76. Impact mechanism spindle 60 delimits a space in which connecting arrangement 78 moves in the impact drilling mode.

Impact mechanism spindle 60 is embodied as a hollow shaft. Impact mechanism spindle 60 is supported rotatably in handheld tool housing 14 on a side facing away from inserted tool securing device 38. Impact mechanism gearbox 28 drives impact mechanism spindle 60. Impact mechanism spindle 60 has for this purpose, on a side facing away from inserted tool securing device 38, a tooth set 82. Guidance cam 76 has an impact coasting region 84, an impact lifting region 86, and an installation cutout 88. Upon installation, connecting arrangement 78 is introduced through installation cutout 88 into securing arrangement 80 of striker 58. In the impact drilling mode, impact mechanism spindle 60 rotates clockwise as viewed in impact direction 66. Impact lifting region 86 is embodied helically. It extends through approximately 180 degrees around a rotation axis 90 of impact mechanism spindle 60. Impact lifting region 86 moves connecting arrangement 78, and thus striker 58, oppositely to impact direction 66 in the impact drilling mode.

Impact coasting region 84 connects two ends 92, 94 of impact lifting region 86. Impact coasting region 84 extends approximately 180 degrees around rotation axis 90 of impact mechanism spindle 60. Impact coasting region 84 has an impact flank 96 that extends, proceeding from that end 92 of impact lifting region 86 which faces toward gearbox 26, approximately parallel to impact direction 66. After connecting arrangement 78 has penetrated into impact coasting region 84, impact mechanism spring 62 accelerates striker 58 and connecting arrangement 78 in impact direction 66. In that context, connecting arrangement 78 moves through impact coasting region 84 without experiencing an axial force, until striker 58 encounters impact surface 46. Impact mechanism spring 62 thus, in at least one operating state, stores at least a portion of an impact energy that striker 58 transfers, upon an impact, onto tool spindle 40.

Figure 6:
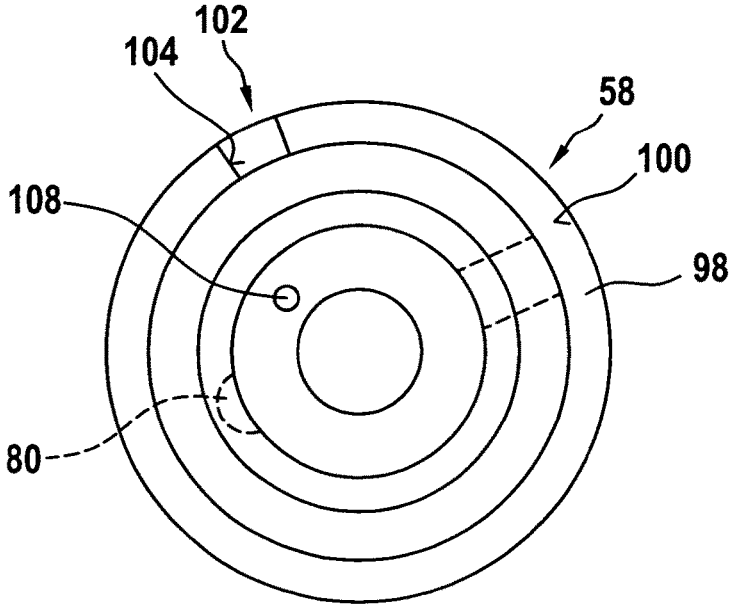
FIG. 6 shows the striker of FIG. 3 viewed in a striking direction.
Figure 7:
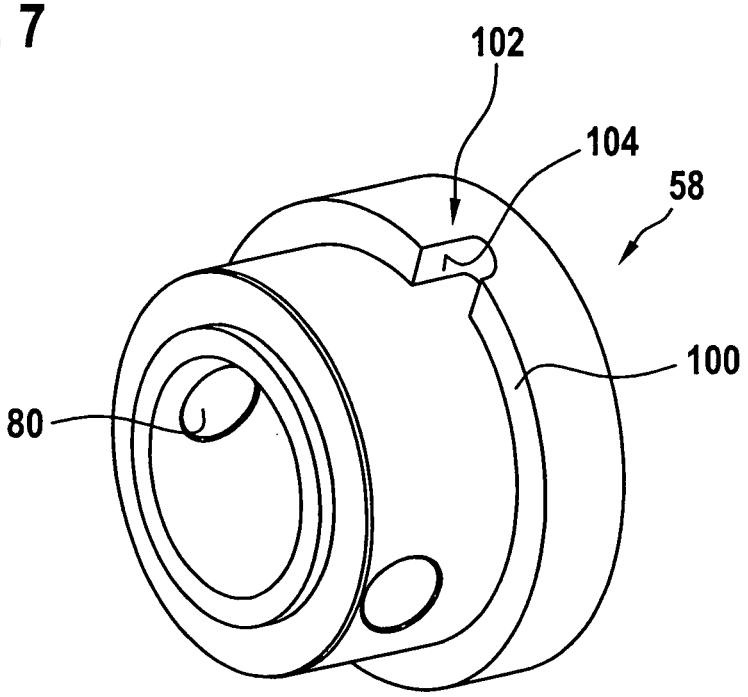
FIG. 7 shows a perspective view of the striker of FIG. 3.

FIGS. 6 and 7 show striker 58. Impact mechanism spring 62 accelerates striker 58 in impact direction 66 prior to an impact. For this, handheld tool housing 14 braces impact mechanism spring 62 on a side facing away from striker 58. Impact mechanism spring 62 pushes directly against striker 58. A substantially annular or helical surface 100 of an annular protrusion 98 on the basic shape of striker 58 braces impact mechanism spring 62. Impact mechanism spring 62 surrounds a portion of striker 58. Impact mechanism spring 62 secures striker 58 in a circumferential direction in the impact drilling mode.

Striker 58 has a capture arrangement 102 on which impact mechanism spring 62 acts in a circumferential direction upon a clockwise rotation of inserted tool securing device 38 in an impact drilling mode. In this exemplifying embodiment, upon clockwise rotation of inserted tool securing device 38, impact mechanism spindle 60 likewise rotates clockwise when viewed in impact direction 66. It is obvious to one skilled in the art to adapt capture arrangement 102 to an impact mechanism spindle 60 rotating counter-clockwise, oppositely to the clockwise rotation.

Capture arrangement 102 has a latching surface 104 that is oriented at least substantially perpendicular to surface 100 of protrusion 98, onto which impact mechanism spring 62 presses in order to accelerate striker 58. Surface 100, onto which impact mechanism spring 62 presses in order to accelerate striker 58, is embodied in a ramp shape and is inclined relative to impact direction 66. Upon clockwise rotation of inserted tool securing device 38, impact mechanism spring 62 acts on latching surface 104 and nonpositively connects striker 58 and impact mechanism spring 62 in a circumferential direction. Upon counter-clockwise rotation of inserted tool securing device 38, impact mechanism spring 62 slides over latching surface 104. Striker 58 and impact mechanism spring 62 thus exhibit a freewheel with respect to one another in a circumferential direction upon counter-clockwise rotation of inserted tool securing device 38. Alternatively, impact mechanism spring 62 could always be connected nonrotatably to striker 58, and impact mechanism spring 62 could exhibit a freewheel with respect to handheld tool housing 14 upon counter-clockwise rotation.

Figure 8:
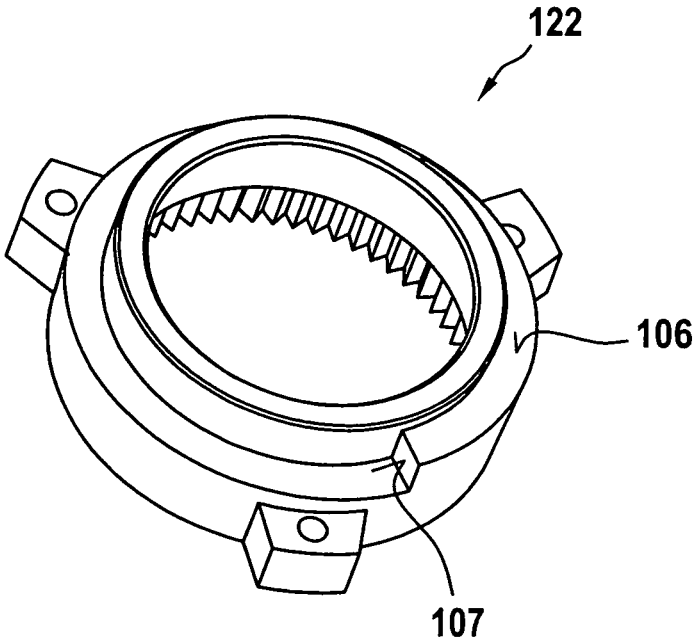
FIG. 8 shows the striker of FIG. 3 viewed in a striking direction.

As FIG. 8 shows, a component of handheld tool 10 connected nonrotatably to handheld tool housing 14, which component here has a ring gear 122 by way of example, has a substantially annular or helical surface 106 that braces impact mechanism spring 62 in a direction oriented oppositely to impact direction 66. Surface 106 is interrupted by a latching surface 107 that is oriented substantially perpendicular to surface 106 of the component. Latching surface 107 is provided in order to exert on impact mechanism spring 62, upon clockwise rotation of inserted tool securing device 38, a force in a circumferential direction that counteracts a motion of striker 58. Latching surface 107 thus nonpositively connects handheld tool housing 14 and impact mechanism spring 62 in a circumferential direction upon clockwise rotation of inserted tool securing device 38. Alternatively, impact mechanism spring 62 could be connected nonrotatably to handheld tool housing 14 on a side facing away from striker 58, for example by the fact that an end of a wire forming impact mechanism spring 62 is curved protrudingly toward drive unit 30. In addition, alternatively to the above-described component having ring gear 122, a different component that seems sensible to one skilled in the art could have latching surface 107, for example a housing part of handheld tool housing 14.

Striker 48 has a vent opening 108 through which, upon a motion of striker 58, air can escape from a space delimited by tool spindle 40, impact mechanism spindle 60, and striker 58, and/or can flow into the space.

Impact mechanism gearbox 28 is disposed between gearbox 26 and impact mechanism 22. Impact mechanism gearbox 28 has a first planetary gearbox stage 110. Gearbox 26 has a second planetary gearbox stage 112, a third planetary gearbox stage 114, and a fourth planetary gearbox stage 116.

Figure 9:
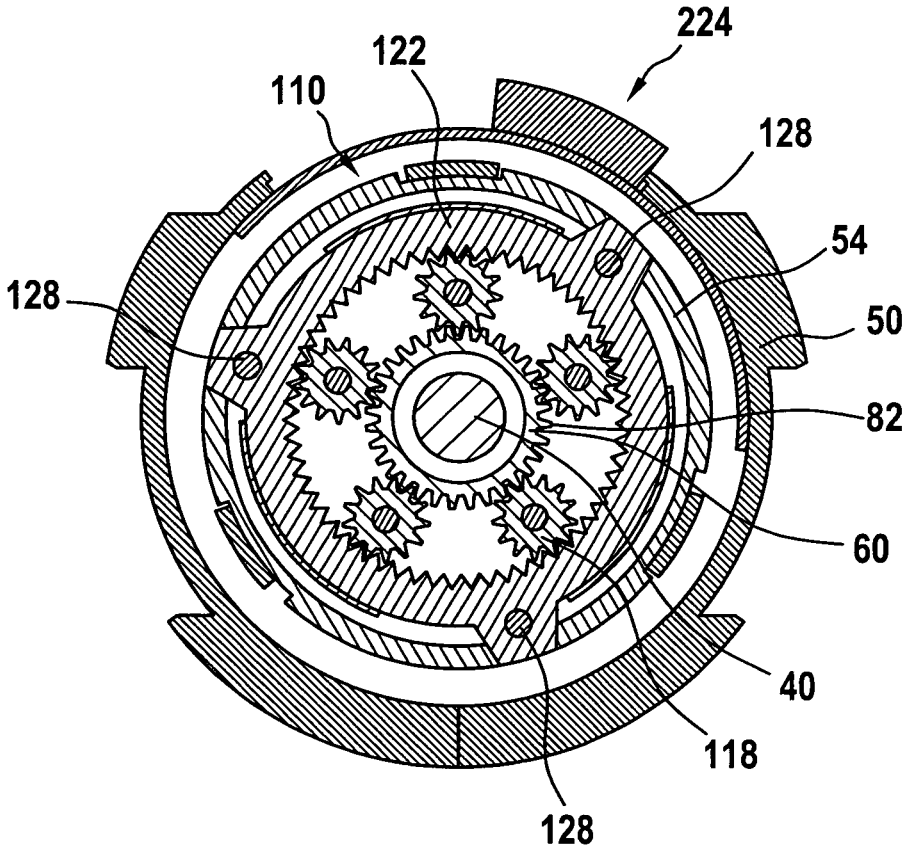
FIG. 9 shows a section surface B through a first planetary gearbox stage of the handheld tool apparatus of FIG. 1.

FIG. 9 shows a section surface B of first planetary gearbox stage 110. First planetary gearbox stage 110 increases a first rotation speed of second planetary gearbox stage 112 in order to drive impact mechanism 22. Second planetary gearbox stage 114 drives tool spindle 40 at this first rotation speed. Tooth set 82 of impact mechanism spindle 60 constitutes a sun gear of first planetary gearbox stage 110. Tooth set 82 meshes with planet gears 118 of first planetary gearbox stage 110, which is guided by a planet gear 120 of first planetary gearbox stage 110. Ring gear 122 of first planetary gearbox stage 110 meshes with planet gears 118 of first planetary gearbox stage 110. Ring gear 122 is connected nonrotatably to handheld tool housing 14.

Impact shutoff apparatus 24 is provided in order to shut off impact mechanism 22 in the context of a screwdriving operation and a drilling operation, and in the impact drilling mode when the inserted tool is unloaded. Impact shutoff apparatus 24 has three transfer arrangement 128, a control arrangement 130, and an impact shutoff clutch 132.

Figure 10:
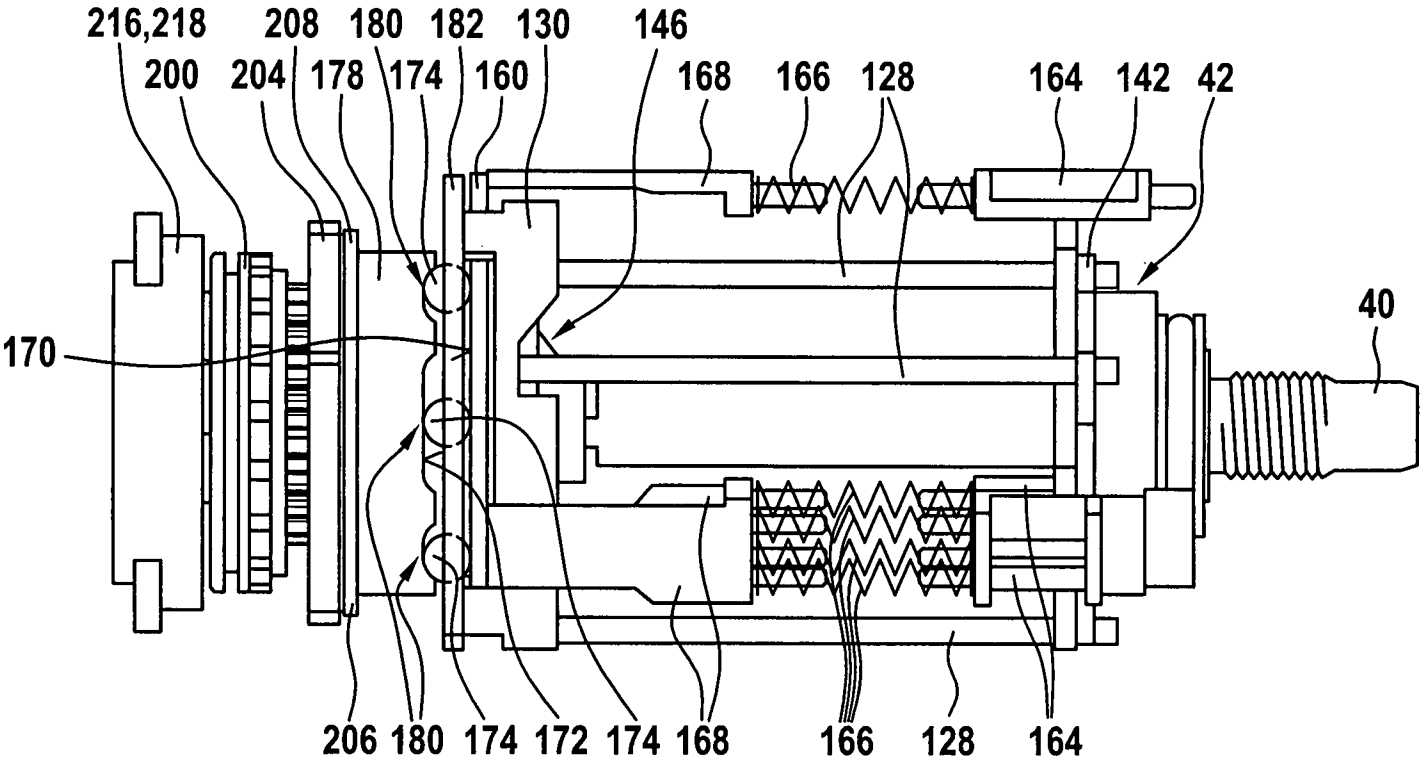
FIG. 10 shows a partly cropped side view of a portion of the handheld tool apparatus of FIG. 1.
Figure 11:
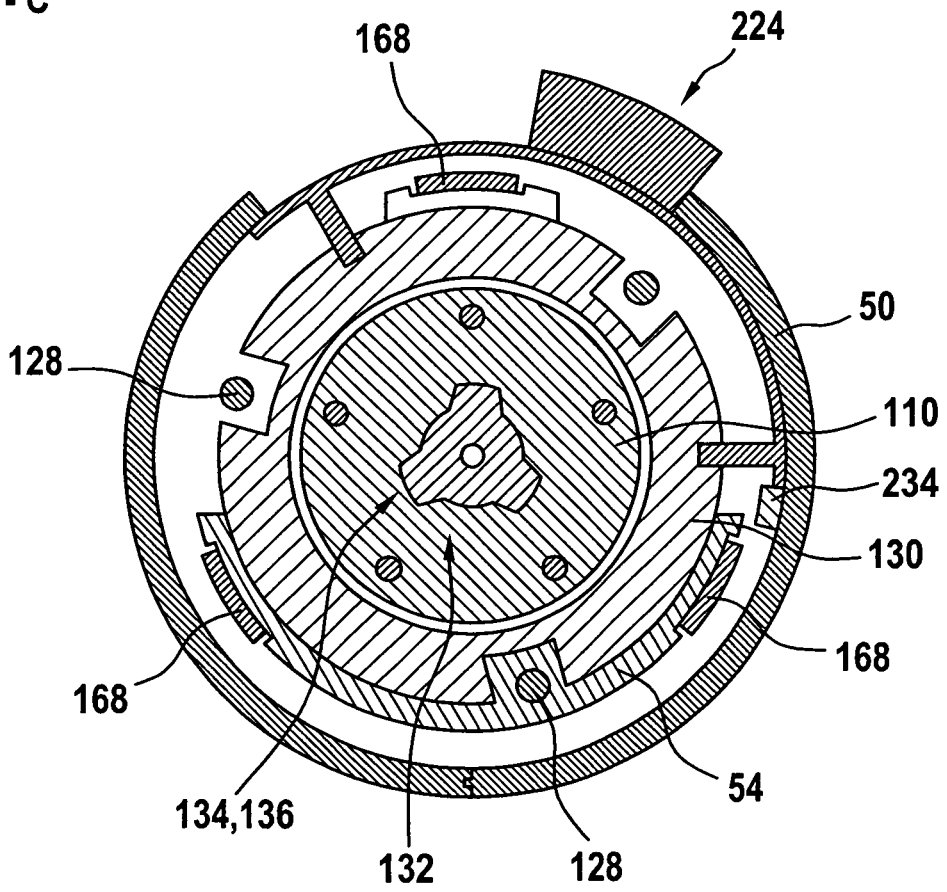
FIG. 11 shows a section surface C through a control element of an impact shutoff apparatus of the handheld tool apparatus of FIG. 1.

FIG. 10 is a cropped side view of impact shutoff apparatus 24. FIG. 11 shows a section surface C through control element 130 of impact shutoff apparatus 24. FIG. 11 furthermore shows a connecting arrangement 124 that nonrotatably connects tool spindle 40 and a planet carrier 126 of second planetary gearbox stage 112. Connecting arrangement 124 axially displaceably connects tool spindle 40 and planet carrier 126 of second planetary gearbox stage 112. Impact shutoff clutch 132 is disposed between first planetary gearbox stage 110 and second planetary gearbox stage 112. Impact shutoff clutch 132 has a first clutch element 134 that is always rotationally coupled to a part of impact mechanism 22. First clutch element 134 is connected nonrotatably to planet carrier 120 of first planetary gearbox stage 110.

First clutch element 134 is embodied integrally with planet carrier 120 of first planetary gearbox stage 110. Impact shutoff clutch 132 has a second clutch element 136 that is always rotationally coupled to a part of gearbox 26. Second clutch element 136 is connected nonrotatably to connecting arrangement 124. Second clutch element 136 is embodied integrally with connecting arrangement 124. Planet carrier 126 of second planetary gearbox stage 112 is connected nonrotatably to second clutch element 136. In the impact drilling mode depicted, impact shutoff clutch 132 is closed. In the impact drilling mode, tool spindle 40 transfers an axial clutch force to impact shutoff clutch 132 when the operator presses the inserted tool against a workpiece. The clutch force closes impact shutoff clutch 132. When the operator lifts the inserted tool away from the workpiece, an impact switching spring 140 of impact shutoff apparatus 24 opens impact shutoff clutch 132.

Transfer arrangement 128 is embodied as rods. In a screwdriving and drilling mode, control element 130 braces tool guidance unit 20 in a direction opposite to impact direction 66. A force applied onto tool guidance unit 20 acts, via bearing arrangement 44, a further transfer arrangement 142 of impact shutoff apparatus 24, and transfer arrangement 128 embodied as rods, on bracing surfaces 144 of control element 130. This prevents clutch elements 134, 136 from coming into engagement in the screwdriving and drilling mode. Further transfer arrangement 142 is embodied substantially in a star shape, with an annular-disk-shaped center region. Control element 130 has three cutouts 146. In the impact drilling mode depicted, transfer arrangement 128 are slid into cutouts 146, with the result that tool guidance unit 20 is axially movable in the impact drilling mode.

Connecting arrangement 124 is arranged in terms of action between planet carrier 126 of second planetary gearbox stage 112 and tool spindle 40. Connecting arrangement 124 furthermore has second clutch element 136 of impact shutoff clutch 132. Connecting arrangement 124 is supported axially displaceably against impact switching spring 140. Impact shutoff clutch 132 is opened by way of an axial displacement of connecting arrangement 124 toward inserted tool securing device 38. Connecting arrangement 124 is always connected nonrotatably and axially displaceably to tool spindle 40. As a result, planet carrier 126 of second planetary gearbox stage 112 remains rotationally coupled to tool spindle 40 even in the context of an impact. Planet carrier 126 of second planetary gearbox stage 112 is connected nonrotatably to connecting arrangement 124. Planet carrier 126 of second planetary gearbox stage 112, and connecting arrangement 124, are connected axially displaceably relative to one another.

Figure 12:
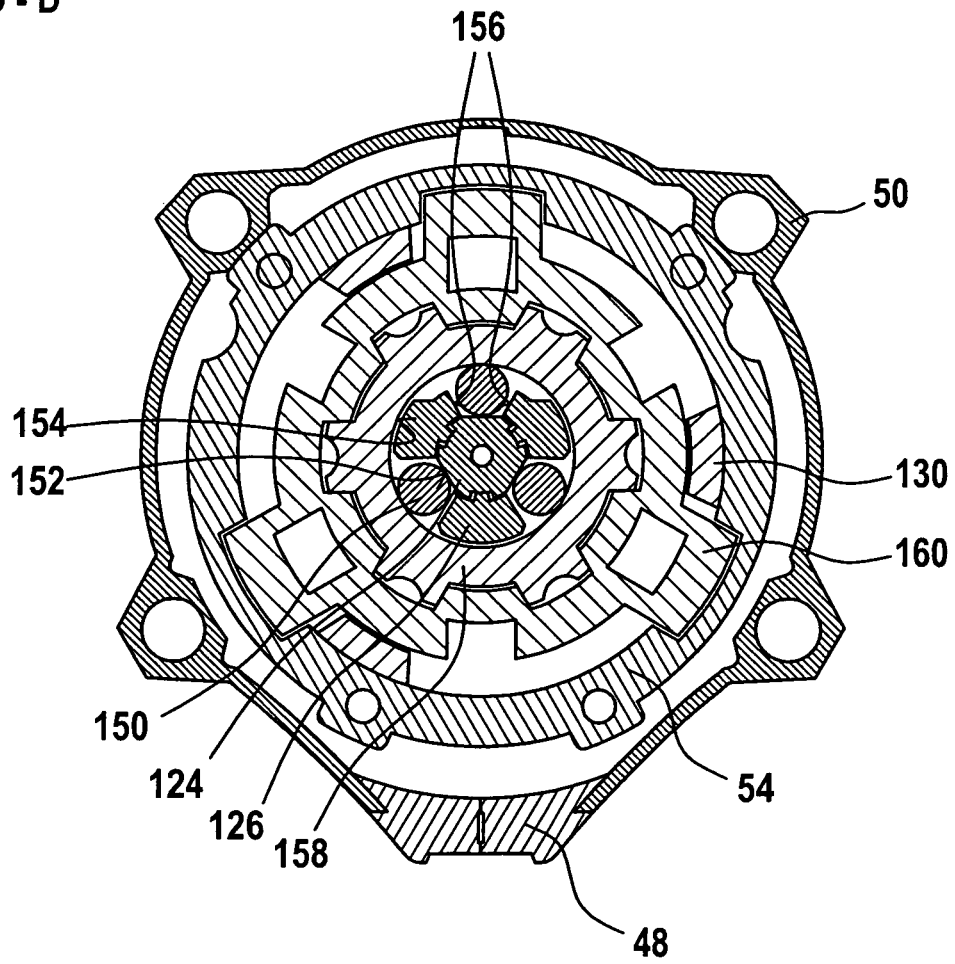
FIG. 12 shows a section surface D through a spindle blocking apparatus of the handheld tool apparatus of FIG. 1.

FIG. 12 shows a section surface D of spindle blocking apparatus 36. Spindle blocking apparatus 36 is provided in order to connect tool spindle 40 nonrotatably to handheld tool housing 14 when a tool torque is applied onto inserted tool securing device 38, for example upon chucking of an inserted tool into inserted tool securing device 38. Spindle blocking apparatus 36 is embodied partly integrally with connecting arrangement 124 and with planet carrier 126 of second planetary gearbox stage 112. Spindle blocking apparatus 36 has blocking arrangement 150, first wedging surfaces 152, a second wedging surface 154, and freewheel surfaces 156. Blocking arrangement 150 are embodied in roller-shaped fashion. First wedging surfaces 152 are embodied as regions of a surface of connecting arrangement 124. First wedging surfaces 152 are embodied to be flat. Second wedging surface 154 is embodied as an inner side of a wedging arrangement 158 of spindle blocking apparatus 36.

Wedging arrangement 158 is embodied as a wedging ring. Wedging arrangement 158 is connected, via a component of spindle blocking apparatus 36, nonrotatably to handheld tool housing 14, specifically to impact mechanism housing 56 of handheld tool housing 14. Wedging arrangement 158 is nonrotatably connected here, via a stop arrangement 160 of spindle blocking apparatus 36, to handheld tool housing 14. Freewheel surfaces 156 are embodied as regions of a surface of planet carrier 126 of second planetary gearbox stage 112. When a tool torque is applied onto inserted tool securing device 38, blocking arrangement 150 wedge between first wedging surfaces 152 and second wedging surface 154. When drive unit 30 is driving, freewheel surfaces 156 guide blocking arrangement 150 on a circular path and prevent wedging. Planet carrier 126 of second planetary gearbox stage 112, and connecting arrangement 124, are toothed with a clearance with respect to one another. Spindle blocking apparatus 36 is disposed outside gearbox housing 52. Spindle blocking apparatus 36 is disposed inside impact mechanism housing 56

Torque limiting unit 34 is provided in order to limit, in a screwdriving mode, a maximum tool torque delivered by inserted tool securing device 38. Torque limiting unit 34 encompasses stop arrangement 160, an operating element 162, positioning elements 164, limiting springs 166, a transfer arrangement 168, first stop surfaces 170, a second stop surface 172, and limiting arrangement 174. Transfer arrangement 168, first stop surfaces 170, and second stop surfaces 172 constitute a clutch of torque limiting unit 34. A maximum torque transferrable to inserted tool securing device 38 can be limited by way of operating element 162. Operating element 162 is embodied annularly. Operating element 162 is embodied with two shells. It is adjacent, in the direction of gearbox 26, to inserted tool securing device 38. Operating element 162 has oblique adjusting surfaces 176 that act in an axial direction on positioning elements 164. Positioning elements 164 are mounted rotatably, and axially displaceably by way of operating element 162. A rotation of operating element 162 displaces positioning elements 164 in an axial direction.

Limiting springs 166 are braced on one side against positioning element 164. Limiting springs 166 are braced on another side via transfer arrangement 168 against stop arrangement 160 of torque limiting unit 34. Transfer arrangement 168 are mounted displaceably in an axial direction. A surface of stop arrangement 160 has first stop surfaces 170. In the screwdriving mode, stop arrangement 160 is mounted movably in an axial direction against limiting springs 166.

Figure 13:
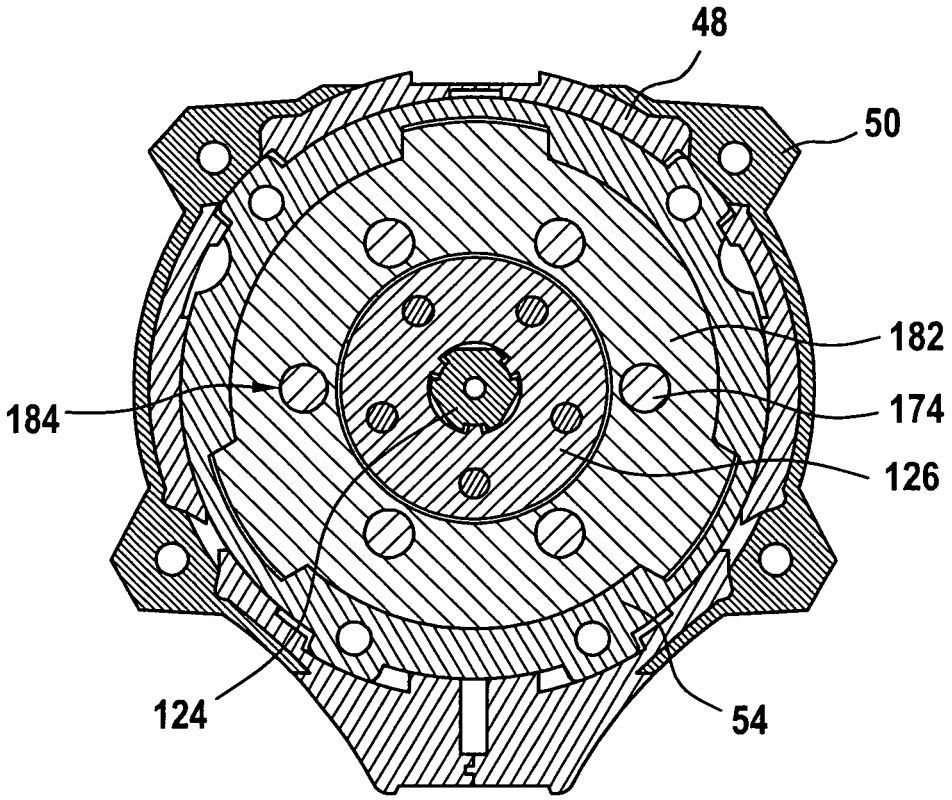
FIG. 13 shows a section surface E through a limiting arrangement guidance arrangement of the spindle blocking apparatus of the handheld tool apparatus of FIG. 1.

Second stop surface 172 is embodied as a region of a surface of a ring gear 178 of second planetary gearbox stage 112. Second stop surface 172 delimits trough-shaped depressions 180. Limiting arrangement 174 are embodied spherically. Torque limiting unit 34 has a limiting arrangement guidance arrangement 182 which is provided in order to support limiting arrangement 174 axially displaceably. FIG. 13 shows a section surface E of limiting arrangement guidance arrangement 182. Limiting arrangement guidance arrangement 182 delimits cutouts 184 in which limiting arrangement 174 are supported displaceably in impact direction 66. Cutouts 184 are embodied in tubular fashion. Impact mechanism gearbox housing 54 nonrotatably secures limiting arrangement guidance arrangement 182. In the context of a screwdriving operation, limiting arrangement 174 are disposed in trough-shaped depressions 180. Limiting arrangement 174 in that context nonrotatably secure ring gear 178 of second planetary gearbox 112. When the maximum tool torque that has been set is reached, limiting arrangement 174 push stop arrangement 160 away against limiting springs 166. Limiting arrangement 174 then each jump into a closest one of trough-shaped depressions 180. Ring gear 178 of second planetary gearbox stage 112 rotates, with the result that the screwdriving operation is interrupted.

Torque limiting unit 34 has shutoff arrangement 186, 188 which are provided in order to shut off a torque limitation of torque limiting unit 34, with the result that a maximum torque is dependent on a maximum torque of drive unit 30. Positioning element 164 and transfer arrangement 168 each have a part of shutoff arrangement 186, 188. At least in a drilling mode, shutoff arrangement 186, 188 prevent an axial motion of stop arrangement 160. Shutoff arrangement 186, 188 are embodied as columnar protrusions on positioning element 164 and on transfer arrangement 168. Shutoff arrangement 186, 188 extend toward one another. Shutoff arrangement 186, 188 are oriented in terms of action parallel to limiting springs 166. In a drilling position of operating element 162 of torque limiting unit 34, shutoff arrangement 186, 188 prevent an axial displacement of stop arrangement 160. Positioning element 164 is in that context displaced sufficiently far toward transfer arrangement 168 that shutoff arrangement 186, 188 abut against one another.

Figure 14:
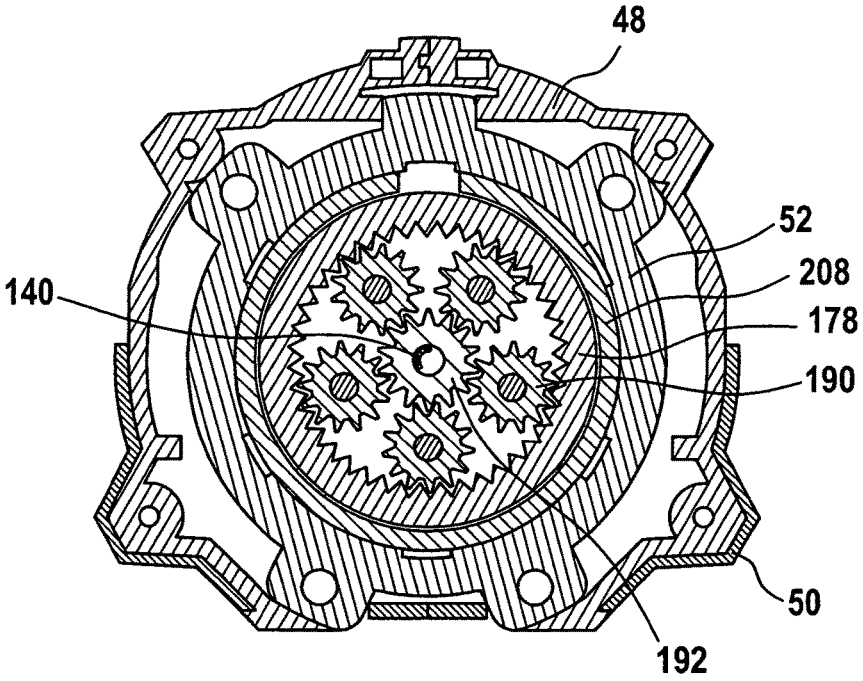
FIG. 14 shows a section surface F through a second planetary gearbox stage of the handheld tool apparatus of FIG. 1.

FIG. 14 shows a section surface F of second planetary gearbox stage 112. Ring gear 178 of second planetary gearbox stage 112 is, at least in a drilling mode, supported in handheld tool housing 14 in a manner protected against complete rotation. Planet gears 190 of second planetary gearbox stage 112 mesh with ring gear 178 and with a sun gear 192 of second planetary gearbox stage 112.

Figure 15:
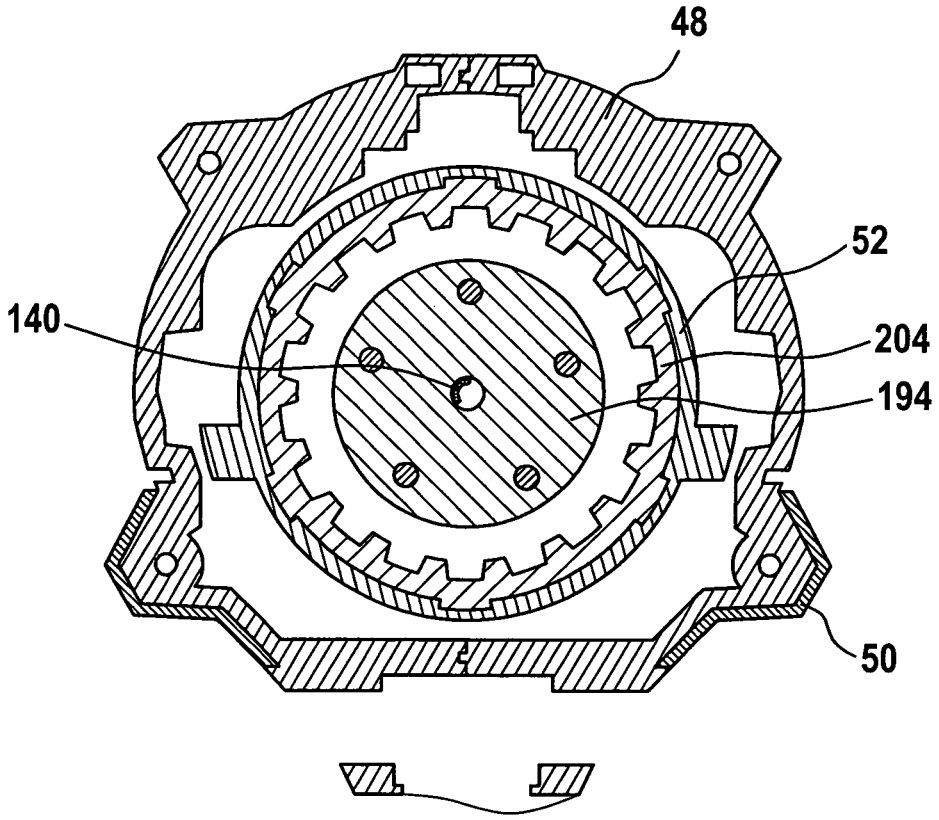
FIG. 15 shows a section surface G through a planet carrier of a third planetary gearbox stage of the handheld tool apparatus of FIG. 1.
Figure 16:
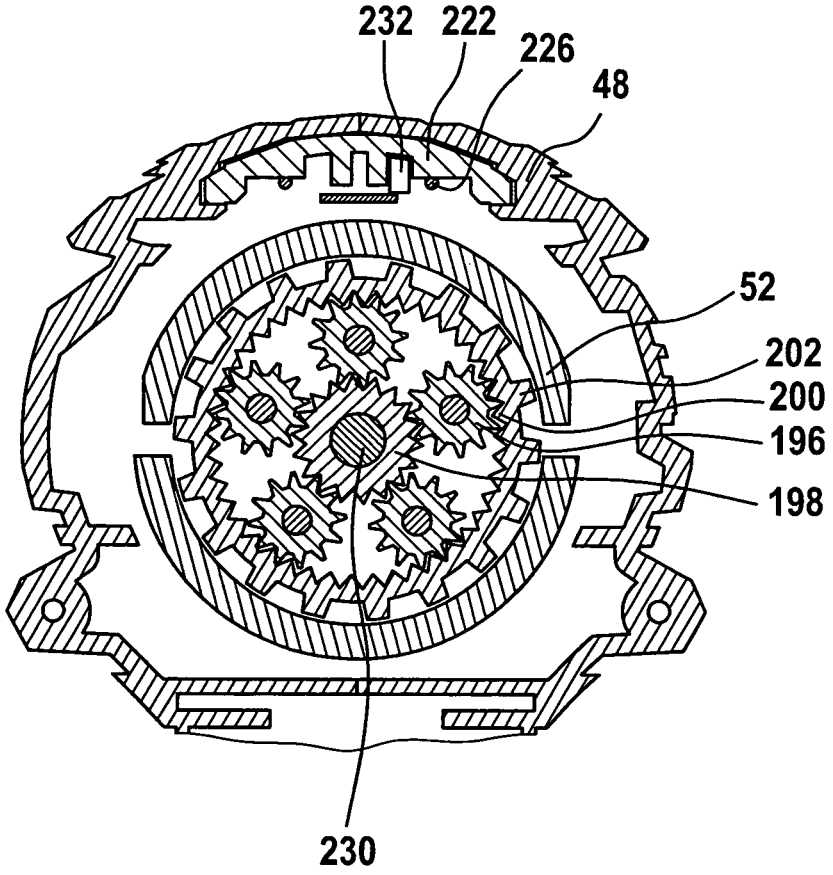
FIG. 16 shows a section surface H through planet gears of the third planetary gearbox stage of the handheld tool apparatus of FIG. 15.

FIG. 15 shows a section surface G through a planet carrier 194 of third planetary gearbox stage 114. FIG. 16 shows a section surface H through planet gears 196 of third planetary gearbox stage 114. Sun gear 192 of second planetary gearbox stage 112 is connected nonrotatably to planet carrier 194 of third planetary gearbox stage 114. Planet gears 196 of third planetary gearbox stage 114 mesh with a sun gear 198 and with a ring gear 200 of third planetary gearbox stage 114.

Ring gear 200 of third planetary gearbox sage 114 has a tooth set 202 that, in a first conversion relationship, connects ring gear 200 of third planetary gearbox stage 114 nonrotatably to handheld tool housing 14. In the first conversion relationship, tooth set 202 of ring gear 200 of third planetary gearbox stage 114 engages into an internal tooth set of a ring 204 that in turn is connected nonrotatably to handheld tool housing 14.

Disposed between second planetary gearbox stage 112 and third planetary gearbox stage 114 is a bracing arrangement 206 which is provided in order to discharge onto handheld tool housing 14 a force, caused in particular by torque limiting unit 34, acting axially on ring gear 200 of third planetary gearbox stage 114. Bracing arrangement 206 is embodied in annular-disk-shaped fashion. Bracing arrangement 206 is nonpositively connected via ring 204, in an axial direction extending away from inserted tool securing device 38, to handheld tool housing 14. A snap ring 208 secures bracing arrangement 206 in an axial direction extending toward inserted tool securing device 38.

Figure 17:
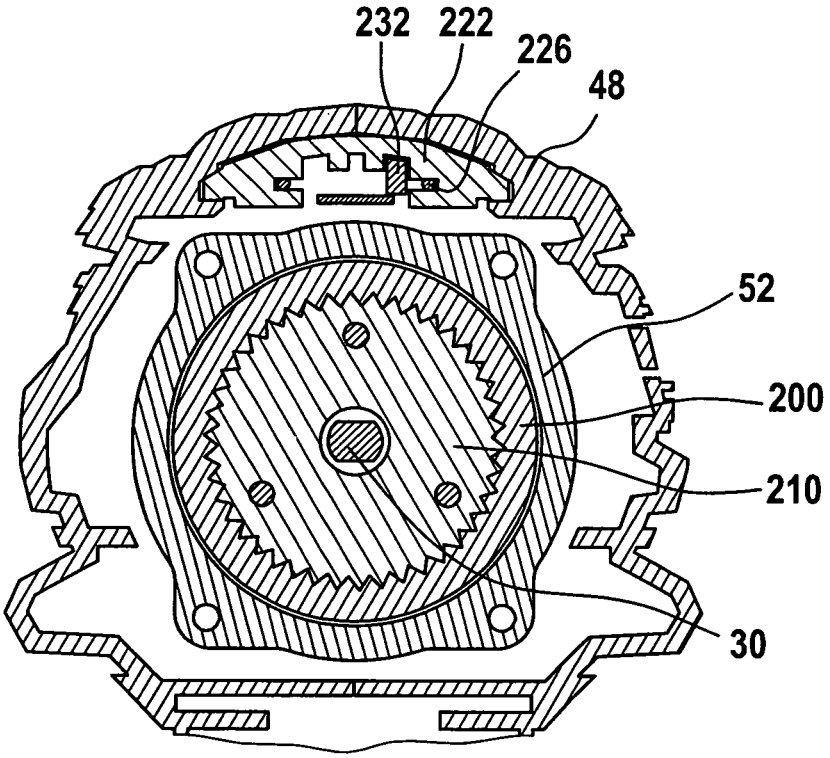
FIG. 17 shows a section surface I through a planet carrier of a fourth planetary gearbox stage of the handheld tool apparatus of FIG. 1.
Figure 18:
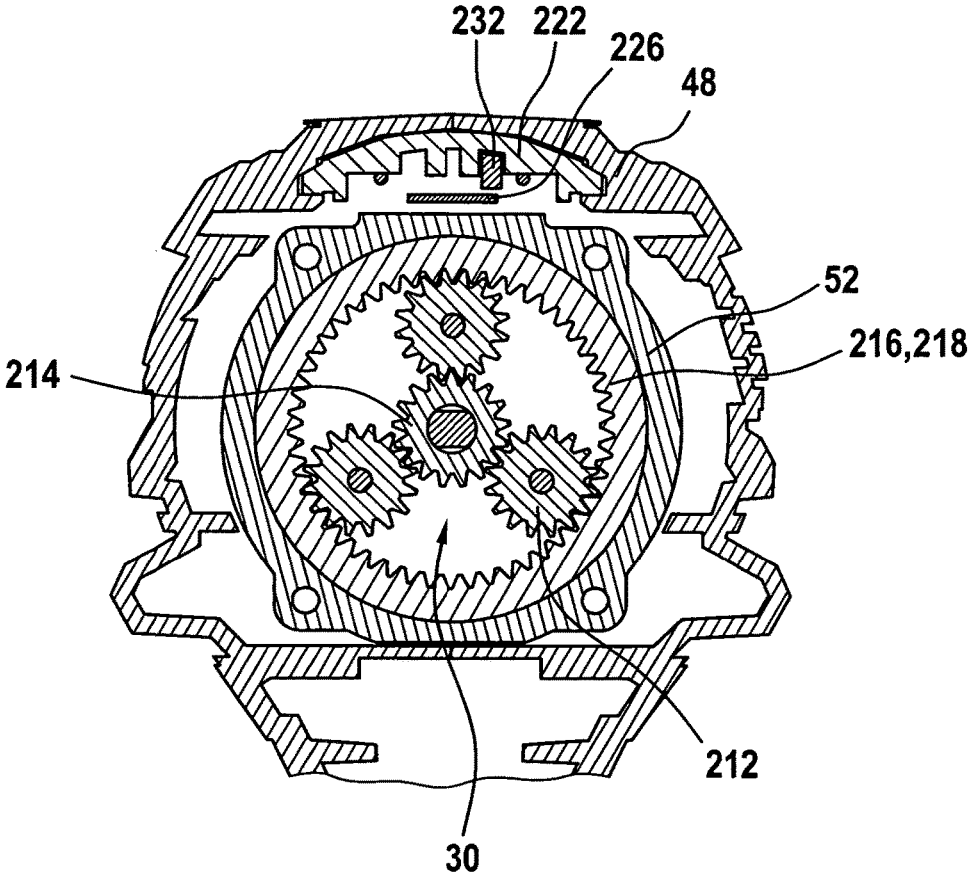
FIG. 18 shows a section surface J through planet gears of a fourth planetary gearbox stage of the handheld tool apparatus of FIG. 17.

FIG. 17 shows a section surface I through a planet carrier 210 of fourth planetary gearbox stage 116. FIG. 18 shows a section surface J through planet gears 212 of fourth planetary gearbox stage 116. Sun gear 198 of third planetary gearbox stage 114 is connected nonrotatably to planet carrier 210 of fourth planetary gearbox stage 116. Planet gears 212 of fourth planetary gearbox stage 116 mesh with a sun gear 214 and a ring gear 216 of fourth planetary gearbox stage 116. Ring gear 216 of fourth planetary gearbox stage 116 is connected nonrotatably to handheld tool housing 14. Ring gear 216 of fourth planetary gearbox stage 116 is embodied integrally with a gearbox housing cover 218 facing away from inserted tool securing device 38. Gearbox housing cover 218 can be embodied integrally with gearbox housing 52, but here is embodied separately. Before gearbox housing 52 is fitted with gearbox 26, gearbox housing cover 218 is connected to gearbox housing 52. Sun gear 214 of fourth planetary gearbox stage 116 is nonrotatably connected to a rotor 220 of drive unit 30.

As shown in FIG. 2, ring gear 200 of third planetary gearbox stage 114 is supported displaceably in an axial direction. In the first conversion relationship, ring gear 200 of third planetary gearbox stage 114 is connected nonrotatably to handheld tool housing 14. In the second conversion relationship, ring gear 200 of third planetary gearbox stage 114 is connected nonrotatably to planet carrier 210 of fourth planetary gearbox stage 116, and is supported rotatably relative to handheld tool housing 14. Planet carrier 210 of fourth planetary gearbox stage 116 has an external tooth set for this purpose. This results in a reduction ratio of the first conversion relationship between rotor 220 of drive unit 30 and planet carrier 194 of third planetary gearbox stage 114 which is greater than a reduction ratio of the second conversion relationship. Inserted tool securing device 38 thus, at a maximum rotation speed of drive unit 30, rotates more slowly in the first conversion relationship than in the second conversion relationship. A maximum torque exertable by drive unit 30 on inserted tool securing device 38 is greater in the first conversion relationship than in the second conversion relationship. A maximum torque exertable by drive unit 30 on inserted tool securing device 38 in the first conversion relationship is 40 Nm. A maximum torque exertable by drive unit 30 on inserted tool securing device 38 in the second conversion relationship is 14 Nm.

Gearbox housing cover 218 is constituted from a plastic. Gearbox housing cover 218 closes off gearbox housing 52 on the side facing away from inserted tool securing device 38. Torque limiting unit 34 is provided in order to close off, in a ready-to-operate state, the side of gearbox housing 52 facing toward inserted tool securing device 38. Impact mechanism gearbox housing 54 secures onto gearbox housing 52 that component of torque limiting unit 34 which, in a ready-to-operate state, closes off the side of gearbox housing 52 facing toward inserted tool securing device 38. Limiting arrangement guidance arrangement 182 of torque limiting unit 34 closes off, in a ready-to-operate state, the side of gearbox housing 52 facing toward inserted tool securing device 38. Limiting arrangement guidance arrangement 182 is constituted from a metallic material. Gearbox housing 52 is fitted, from a side facing toward inserted tool securing device 38, with at least the second, the third, and the fourth planetary gearbox stage 112, 114, 116 of gearbox 26.

Operating apparatus 32 has a first operating element 222 and a second operating element 224. First operating element 222 is disposed on a side of handheld tool housing 14 facing away from handle 18. Said element is supported movably parallel to the axial direction of gearbox 26. First operating element 222 is connected in an axial direction, via a positioning arrangement 226 of operating apparatus 32, to ring gear 200 of third planetary gearbox stage 114. Ring gear 200 of third planetary gearbox stage 114 has a groove 228 into which positioning arrangement 226 engages. Ring gear 200 of third planetary gearbox stage 114 is thus connected in an axial direction to positioning arrangement 226, axially rotatably relative to adjusting arrangement 226. Positioning arrangement 226 is embodied resiliently, with the result that the conversion relationship can be adjusted independently of a rotational position of ring gear 200 of third planetary gearbox stage 114. When first operating element 222 is slid in the direction of inserted tool securing device 38, the first conversion relationship is established. When first operating element 222 is slid away from inserted tool securing device 38, the second conversion relationship is established.

Second operating element 224 is disposed on a side of handheld tool housing 14 facing away from handle 18. Second operating element 224 is disposed displaceably around an axis that is oriented parallel to the axial direction of gearbox 26. Second operating element 224 mechanically activates or deactivates the impact drilling mode upon an actuation. Second operating element 224 is connected nonrotatably to control element 130 of handheld tool apparatus 12. The screwdriving and drilling mode and the impact drilling mode can be established by way of second operating element 224. When second operating element 224 is slid to the left (viewed in impact direction 66) the impact drilling mode is established. When second operating element 224 is slid to the right (viewed in impact direction 66) the screwdriving and drilling mode is established.

In the context of an impact drilling mode, impact switching spring 140 of handheld tool apparatus 12 opens impact shutoff clutch 132 when the operator lifts the inserted tool away from the workpiece. Impact switching spring 140 is disposed coaxially with planetary gearbox stages 110, 112, 114, 116 of gearbox 26. Second planetary gearbox stage 112 and third planetary gearbox stage 114 respectively surround impact switching spring 140 at least in a plane that is oriented perpendicular to the axial direction of gearbox 26. Connecting arrangement 128 braces impact switching spring 140 on a side facing toward inserted tool securing device 38. A bearing arrangement 230 braces impact switching spring 140 on a side facing away from inserted tool securing device 38. Bearing arrangement 230 is embodied as a ball. Bearing arrangement 230 is disposed between impact switching spring 140 and rotor 220 of drive unit 30.

Handheld tool apparatus 12 has a first sensing unit 232 and a second sensing unit 234. First sensing unit 232 is provided in order to electrically output a parameter that depends on whether impact mechanism 22 is activated, i.e. in the impact drilling mode, or deactivated, i.e. in the drilling and screwdriving mode. First sensing unit 232 is embodied as a switch that senses a motion of second operating element 224 relative to handheld tool housing 14. Alternatively, sensing unit 232 could sense a motion of another part of impact mechanism 22 which seems sensible to one skilled in the art.

Second sensing unit 234 is provided in order to electrically output a second parameter that depends on which of the conversion relationships of gearbox 26 is established by way of first operating element 222. Sensing unit 234 is embodied as a switch that senses a motion of first operating element 222 relative to handheld tool housing 14. Alternatively, sensing unit 234 could sense a motion of another part of gearbox 26 which seems sensible to one skilled in the art.

Handheld tool apparatus 12 has a control unit 236 which is provided in order to control drive unit 30 upon operation. Control unit 236 encompasses a microcontroller and a power electronics system. The power electronics system is provided in order to energize drive unit 30 with energy for different rotation speeds and/or different torques. The microcontroller is provided in order to control drive unit 30 by way of the power electronics system as a function of the first parameter and the second parameter. Control unit 236 encompasses a protection function, which is provided in order to limit a maximum torque delivered by drive unit 30 in the Operating mode when the impact drilling mode is activated and the first conversion relationship, i.e. a low maximum rotation speed and a high maximum torque, is established. Control unit 236 then limits a maximum electrical current delivered to drive unit 30.

Handheld tool apparatus 12 has an impact mechanism spindle bearing arrangement 238 that rotatably supports impact mechanism spindle 60 on the side facing away from inserted tool securing device 38. Impact mechanism spindle bearing arrangement 238 is connected fixedly in an axial direction to impact mechanism spindle 60; specifically, impact mechanism spindle bearing arrangement 238 is press-fitted to impact mechanism spindle 60. Additionally or, advantageously, alternatively, impact mechanism spindle bearing arrangement could be connected to handheld tool housing 14 fixedly in an axial direction.

Handheld tool apparatus 12 has an impact mechanism spindle securing arrangement 242 which is provided in order to secure impact mechanism spindle 60 in an axial direction. Impact mechanism spindle securing arrangement 242 is embodied as a snap ring. Impact mechanism spindle securing arrangement 242 engages into a groove 240 of impact mechanism spindle 60. Groove 240 of impact mechanism spindle 60 is disposed on the side of impact mechanism spindle 60 facing away from inserted tool securing device 38.

In a ready-to-operate state, impact mechanism spindle securing arrangement 242 is disposed in an axial direction between impact mechanism spindle bearing arrangement 238 and first planetary gearbox stage 110. Impact mechanism spindle securing arrangement 242 nonpositively secures impact mechanism spindle 60 in an axial direction. Alternatively, impact mechanism spindle 60 could be secured in an axial direction in another manner that seems sensible to one skilled in the art. For example, impact mechanism spindle bearing arrangement 238 could be intermaterially or frictionally connected to impact mechanism spindle 60 in an axial direction.

What is claimed is:

1. A handheld tool apparatus, comprising:

a spindle blocking apparatus; and a torque limiting unit having at least one limiting spring and a stop arrangement that is supported movably against the limiting spring;

wherein the stop arrangement of the torque limiting unit nonrotatably secures a wedging arrangement of the spindle blocking apparatus at least upon connection of the wedging arrangement to the stop arrangement, wherein the spindle blocking apparatus includes a blocking arrangement embodied as rollers which are configured to wedge between at least one first wedging surface and at least one second wedging surface when a tool torque is applied onto an inserted tool securing device, wherein the at least one first wedging surface is embodied as a region of a surface of at least one of a tool spindle and a connecting arrangement coupled to the tool spindle, wherein the wedging arrangement is embodied as a wedging ring, wherein an inner surface of the wedging ring forms a second wedging surface of the at least one second wedging surface, wherein the spindle blocking apparatus includes freewheel surfaces which are embodied as regions of a surface of a planet carrier of a planetary gearbox stage.

2. The handheld tool apparatus of claim 1, further comprising:

a gearbox housing that nonrotatably secures the stop arrangement.

3. The handheld tool apparatus of claim 2, wherein the torque limiting unit closes off a side of the gearbox housing facing toward an inserted tool securing device in a ready-to-operate state.

4. The handheld tool apparatus of claim 2, further comprising:

an inserted tool securing device, wherein the gearbox housing is fitted with at least one planetary gearbox stage of the gearbox, in a ready-to-operate state, from a side facing toward the inserted tool securing device.

5. The handheld tool apparatus of claim 1, further comprising:

an impact mechanism gearbox to increase a rotation speed for impact generation.

6. The handheld tool apparatus of claim 5, wherein the stop arrangement is disposed between the impact mechanism gearbox and the gearbox.

7. The handheld tool apparatus of claim 1, further comprising:

a drive unit and a gearbox to reduce a rotation speed of the drive unit.

8. The handheld tool apparatus of claim 1, further comprising:

an impact mechanism having a striker and having at least one cam guide that drives the striker at least in an impact drilling mode.

9. The handheld tool apparatus of claim 8, wherein the striker has at least a part of the cam guide.

10. The handheld tool apparatus of claim 1, wherein the torque limiting unit further comprises an operating element operable to limit a maximum torque transferrable to an inserted tool securing device.

11. The handheld tool apparatus of claim 1, further comprising:

a connecting arrangement that nonrotatably connects a tool spindle and a planet carrier of a planetary gearbox, wherein the planet carrier and the connecting arrangement are toothed with a clearance with respect to one another.

12. The handheld tool apparatus of claim 1, wherein the spindle blocking apparatus is configured to connect a tool spindle nonrotatably to a handheld tool housing when a tool torque is applied onto an inserted tool securing device.

13. The handheld tool apparatus of claim 1, wherein when a driving unit is driving, the freewheel surfaces guide the rollers on a circular path and prevent wedging.

14. A handheld tool, comprising:

a handheld tool apparatus, including:

a spindle blocking apparatus; and a torque limiting unit having at least one limiting spring and a stop arrangement that is supported movably against the limiting spring;

wherein the stop arrangement of the torque limiting unit nonrotatably secures a wedging arrangement of the spindle blocking apparatus at least upon connection of the wedging arrangement to the stop arrangement, wherein the spindle blocking apparatus includes a blocking arrangement embodied as rollers which are configured to wedge between at least one first wedging surface and at least one second wedging surface when a tool torque is applied onto an inserted tool securing device, wherein the at least one first wedging surface is embodied as a region of a surface of at least one of a tool spindle and a connecting arrangement coupled to the tool spindle, wherein the wedging arrangement is embodied as a wedging ring, wherein an inner surface of the wedging ring forms a second wedging surface of the at least one second wedging surface, wherein the spindle blocking apparatus includes freewheel surfaces which are embodied as regions of a surface of a planet carrier of a planetary gearbox stage.

15. The handheld tool of claim 14, wherein the handheld tool is an impact drill driver.

* * * * *